US006209749B1

(12) United States Patent
Guess

(10) Patent No.: US 6,209,749 B1
(45) Date of Patent: Apr. 3, 2001

(54) GAS CYLINDER SAFETY SHIELD

(76) Inventor: William H. Guess, 2 Wildwood Rd., Portland, CT (US) 06480

( * ) Notice: Subject to any disclaimer, the term of this patent is extended or adjusted under 35 U.S.C. 154(b) by 0 days.

(21) Appl. No.: 09/415,441

(22) Filed: Oct. 8, 1999

(51) Int. Cl.[7] ..... B65D 51/00
(52) U.S. Cl. ..... 220/724; 220/728; 137/377; 137/382
(58) Field of Search ..... 220/724, 728, 220/725; 137/377, 382

(56) References Cited

U.S. PATENT DOCUMENTS

| | | | | |
|---|---|---|---|---|
| D. 273,510 | * | 4/1984 | Mayor | 220/724 X |
| 1,977,268 | | 10/1934 | Endacott . | |
| 2,339,930 | * | 1/1944 | Howick | 220/724 |
| 3,129,746 | * | 4/1964 | Kroesch | 220/724 X |
| 3,696,964 | | 10/1972 | Deakin . | |
| 3,848,768 | * | 11/1974 | Griffin | 220/724 |
| 4,103,806 | * | 8/1978 | White | 220/724 X |
| 4,352,370 | | 10/1982 | Childress . | |
| 4,521,676 | | 6/1985 | Poulsen . | |
| 4,600,033 | | 7/1986 | Baron . | |
| 5,058,758 | | 10/1991 | Suddeth . | |
| 5,429,152 | | 7/1995 | Van Straaten et al. . | |
| 5,638,858 | | 6/1997 | Gettinger et al. . | |
| 5,845,809 | * | 12/1998 | Garrett et al. | 220/728 |

* cited by examiner

*Primary Examiner*—Steven Pollard
(74) *Attorney, Agent, or Firm*—Robert A. Seemann

(57) ABSTRACT

A lower portion of a shell is slidable along the length of the body of a gas cylinder, the upper portion of the shell is larger than the lower portion and includes a wall extending fixedly from the lower portion configured to laterally surround the valve, gauge and regulator on an end of the gas cylinder and is movable with the lower portion so that it can movably extend over the body of the cylinder. In another design, a rigid shield is mounted on a bar so that it extends over a periphery of the valve, gauge and regulator group that is mounted on an end of the gas cylinder to protect the group against damage by a foreign object when the cylinder is pressed into spaced apart brackets on the bar that prevent rotation of the cylinder around the bar, by a belt around the cylinder and bar. At least one of the brackets is configured to receive a second cylinder.

17 Claims, 4 Drawing Sheets

GAS CYLINDER SAFETY SHIELD

BACKGROUND OF THE INVENTION

1. Field of the Invention

The invention pertains to safe fluid handling, more specifically to a guard for protecting the valve, gauge, and regulator of a compressed gas cylinder from impact by foreign objects.

2. Description of the Prior Art

The prior art is replete with patented designs for caps and covers for standard compressed gas cylinder for protecting elements at the top of the cylinder from impact by foreign objects.

U.S. Pat. No. 4,352,370 patented by S. Childress on Oct. 5, 1982 describes a vertical first half-cover attached to the cylinder by a strap that is closed by a nut and screw through ears on the strap. The nut is welded to an ear so that it cannot be turned. A vertical second-half cover is hinged with the first half cover so that it swings open on the vertical hinge to provide access to the tank valve, gauge and regulator, and swings closed to the first half-cover to enclose the valve, gauge and regulator, and to cover the screw head with a tab that is configured for a padlock.

U.S. Pat. No. 4,600,033 patented by M. Baron on Jul. 15, 1986 describes an incomplete cylindrical collar, being an incomplete circle in cross section, wraps around the body of the tank and extends, with the same diameter, higher than the valve, gauge and regulator. The collar is open at the top, has hand openings through it on opposite sides near the top, and has a wide vertical gap defined by a pair of parallel vertical radial flanges, one flange on each end of the incomplete circle, and maintained by a pair of horizontal bars that space the gap but allow for drawing the collar tight around the outside of the tank. The opening provides access by the user to the valve, gauge, and regulator. The valve can also be reached through the open top of the collar.

U.S. Pat. No. 5,058,758 patented by B. Suddeth on Oct. 22, 1991 describes two chambers mounted on the threads of a compressed gas cylinder, the first chamber is a cube containing the gauges and regulator, and the second chamber which is domed contains the cylinder valve. A shatter-proof transparent window is provided on the side of the first chamber to view the gauges. The cylinder valve can be operated by a "T" handle shaft through a small hole in the dome at the top of the second chamber. For strength, adjustable opposing impact blocks are wedged between the interior surface of the second chamber and on opposing sides of the exterior surface of the body of the cylinder valve.

U.S. Pat. No. 5,638,858 patented by Gettinger et al. on Jun. 17, 1997 describes a chamber having perforated metal sides for viewing the gauges contained therein, and a hinged door or hinged upper portion for opening the chamber for access to the regulator and valve. The chamber has a horizontal bottom plate that is releasably threadedly to the threaded top of a compressed gas cylinder, and the chamber is also attached to the body of the cylinder by a circular clamp. The bottom plate has a hole for passing hose through from outside the chamber to the valve.

U.S. Pat. No. 5,429,152 patented by Van Straaten et al. on Jul. 4, 1995 describes a cap that has a lower stepped central split recess for fitting and clamping the cap on the neck of a portable oxygen cylinder. The upper end of the cap has lateral ribs which receive a horizontally ribbed handle. One side of the cap has a recess at the bottom for hanging the cylinder on a hook by the cap. Two lateral openings in the upper portion of the cap provide access to low pressure and medium pressure gas outlets. A lateral opening on the opposite side of the upper portion of the cap is provides access to a coupling for filling the cylinder. An central cylindrical passage through the top of the cap provides access to a flow rate regulator.

SUMMARY OF THE INVENTION

It is one object of the invention to provide a shield for high pressure gas cylinders that protects the valve, regulator, and gauges that are mounted on the top end of the cylinder from blows or strikes from foreign objects.

It is another object of the invention that the shield can be moved down from the regulator, gauges and valve.

It is another object that the shield can be moved down on the cylinder, away from around the regulator, gauges and valve.

It is another object that the shield can be installed on the tank from the bottom end of the tank.

It is another object that the shield can be molded in one piece.

It is another object that the valve control can be operated while the shield is in-place.

It is another object that the valve control can be operated from the top of the tank, and that piping can be attached to or tightened on the valve while the shield is mounted on the tank.

A gas cylinder safety cover for protecting a valve, gauge and regulator mounted on the top of a gas cylinder from damage, includes:

- a shell having a top, a lower portion of the shell, slidable along the length of the body of the gas cylinder,
- an upper portion of the shell larger in diameter than the lower portion, open at the top of the shell, including a wall configured to laterally surround the valve, gauge and regulator as the top of the upper portion moves with the lower portion past at least one of the valve, gauge, and regulator when the lower portion is slid along the length of the body of the gas cylinder away from the valve, gauge and regulator.

In one construction of the invention, the top of the upper portion of the cover is configured for passing the valve, gauge, and regulator when the lower portion is slid along the length of the body of the gas cylinder away from the top of the cylinder.

The wall forms an opening in the shell adjacent to the second portion.

A gas cylinder safety shield for protecting a valve, gauge and regulator mounted on one end of a gas cylinder, said safety shield includes:

- a bar, a rigid shield mounted on the bar, a first bracket mounted on the bar fixed against rotation around the bar, configured for receiving a gas cylinder,
- means for pressing the gas cylinder against the bracket, mounted on the bar,
- the rigid shield being configured for extending over a lateral periphery of the valve, gauge and regulator group when the gas cylinder is pressed against the bracket to protect the group from damage by a foreign object.

A second bracket is spaced along the bar from the first bracket, mounted on the bar fixed against rotation around the bar, configured for receiving the gas cylinder for preventing rotation of the cylinder around the bar.

The first bracket is configured for receiving a second gas cylinder for preventing rotation of the second cylinder around the bar.

The rigid shield is angled from a plane that is perpendicular to the bar.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
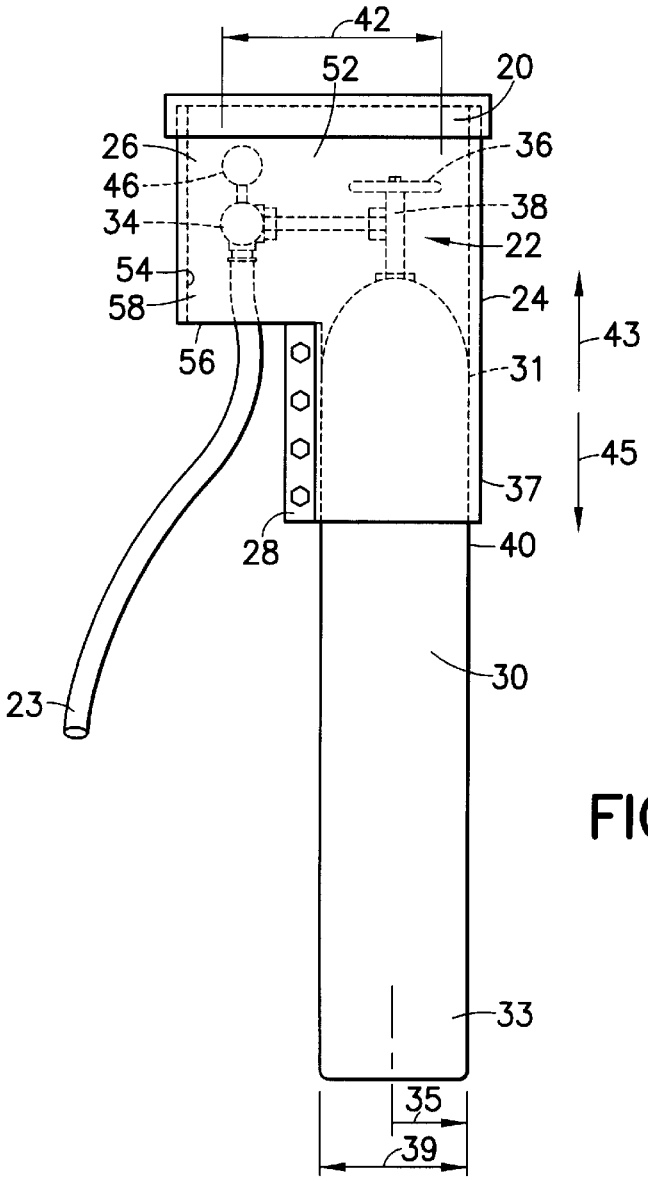
FIG. 1 is a side view of a shield with removable cover mounted on a tank.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 2:
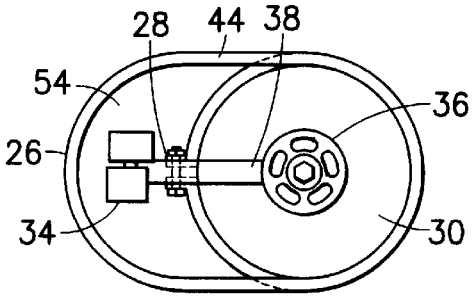
FIG. 2 is a top view of the shield and tank of FIG. 1 with the cover removed.
Figure 3:
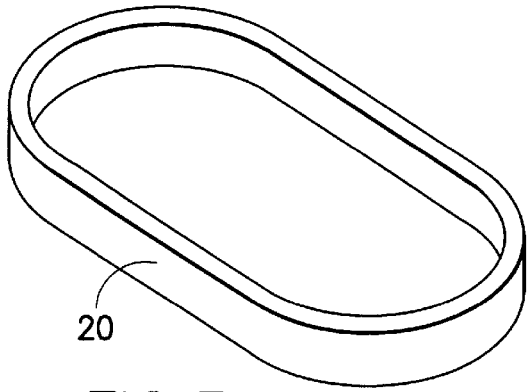
FIG. 3 is a bottom perspective view of the removable cover of FIG. 1.
Figure 4:
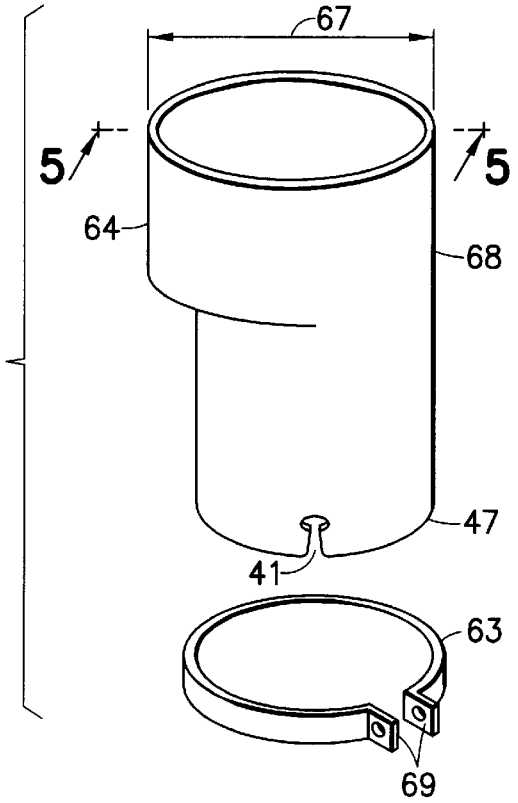
FIG. 4 is a front perspective view of another shield of the invention.
Figure 5:
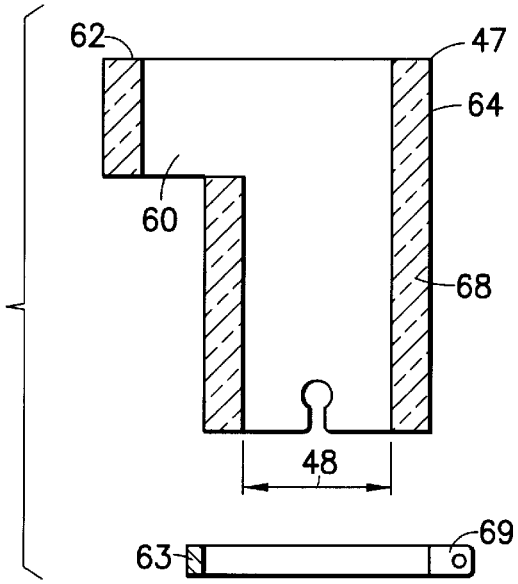
FIG. 5 is a cross sectional view of the shield of FIG. 4 taken along 5—5.
Figure 6:
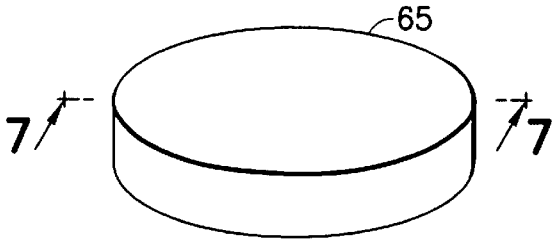
FIG. 6 is a front perspective view of the cover for the shield of FIG. 4.
Figure 7:
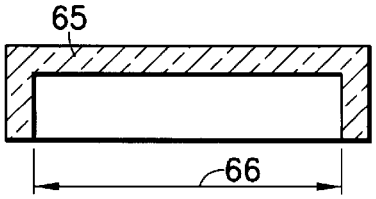
FIG. 7 is a cross sectional view of the cover of FIG. 6 taken along 7—7.
Figure 8:
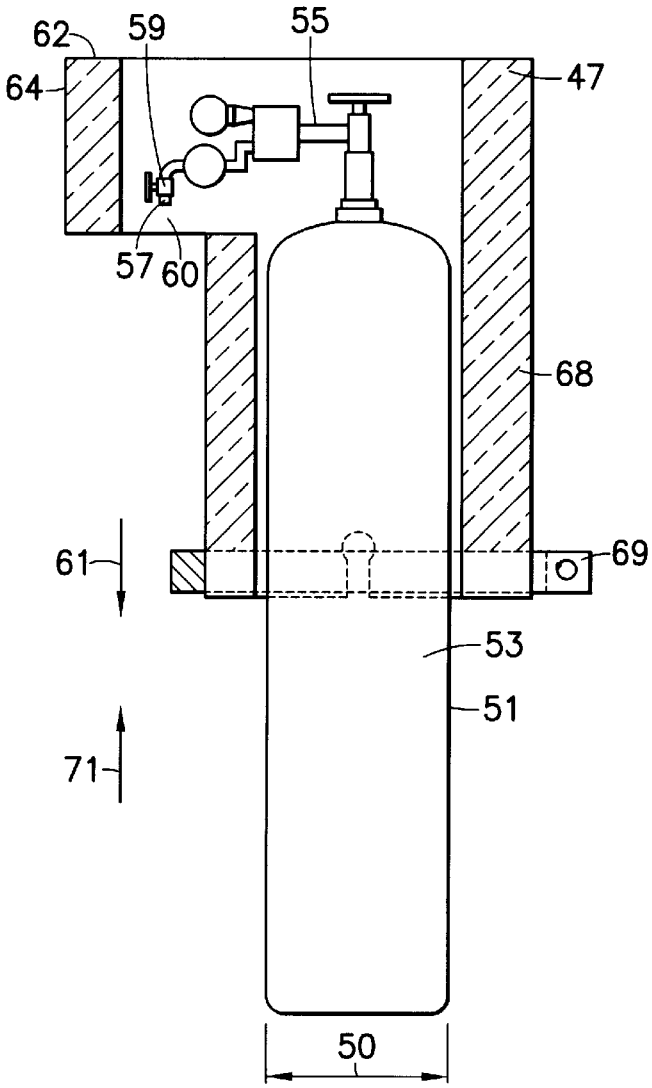
FIG. 8 is a schematic view of the cover of FIG. 4 in cross section, on a tank.

Referring to FIGS. 1–3, cover 20 fits on shell 24 of shield 26 that fits on tank 30.

Tank 30 is a standard pressurized gas tank. Such pressurized tanks include oxygen, acetylene, and nitrogen tanks like those used for welding and medical applications. Examples of pressurized tanks are tank 30, 122, and 124. The tanks respectively have cylindrical bodies 40, 123 and 125.

Shell 24 is made of impact resistant material. Metals such as steel and aluminum, and high impact plastics are suitable.

Shell 24 upper portion 58 surrounds control system 22 which includes regulator 34, valve 38, and gauges 46, preventing damage to them from blows from objects of all size hitting from the side, and from blows from objects larger than opening 44 hitting from the top. Control system 22 preferably includes control handle 36.

Removable cover 20, made of impact resistant material, fits on shell 24. Cover 20 extends over control system 22 and as far laterally as the lateral periphery 42 of control system 22. The cover prevents damage to the control system from the top by objects smaller than opening 44 at the top 52 of shell 24.

The shell may have a transparent portion, not shown, for monitoring of gauges 46 through the side of the shield by a user.

Pipe 23 enters shell 24 through opening 54 in bottom 56 of upper portion 58 of the shell. The bottom of upper portion 58 is larger in diameter than the diameter of lower portion 37

Shell 24 can be mounted on standard pressurized gas tank 30 from top end 31 of the tank when there are no attachments to the tank on the top that extend beyond radius 35 of the tank. The inner diameter of lower portion 37 of shell 24 is slightly larger than the outer diameter 39 of the cylindrical body of tank 30.

Shell 24 can be mounted on tank 30 from bottom end 33 of the tank, slid up 43 the tank until the shell surrounds control system 22, then tightened on body 40 by tightening bolts on the pair of flanges 28.

Access to the regulator for attaching pipes and maintenance is made easy with the invention. Shell 24 is slid down 45 the tank until control system 22 is accessible from the side or bottom of the control mechanism, say for attaching pipe 23.

In FIGS. 4–8, shield 47 is molded in one piece of impact resistant plastic. Preferably the plastic is transparent so that the control system is visible from any side of the shield.

Inside diameter 48 is slightly larger than the outside diameter 50 of tank 51. Shield 47 is slid up 71 the body of constant diameter 50 of the tank until the shield surrounds control system 55 mounted on the tank. Access to pipe 57 and valve 59 is through opening 60 or from any direction when shield 47 is slid down 61 on tank 51 body 53 until the top end 62 is sufficiently below pipe 57 to attach a delivery pipe configured so that the delivery pipe can pass through opening 60 when the shield is slid back up over the control system.

Cover 65 inside diameter 66 is slightly larger than outer diameter 67 of upper portion 64 of the shield, so that cover 65 fits snugly on the shield. The cover protects control system 55 from strike by a foreign object from above shell 68 of the shield.

Shell 68 of the shield is tightened around the tank by ring 63 which is tightened around shell 68 by drawing together flanges 69. Relieved slot 41 is reduced by tightening of the ring.

Figure 10:
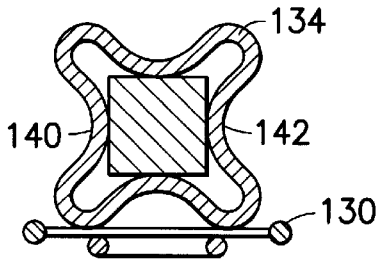
FIG. 10 is a top cross section schematic view of a bracket of the shield of FIG. 9, viewed along 10—10, without the strap.
Figure 9:
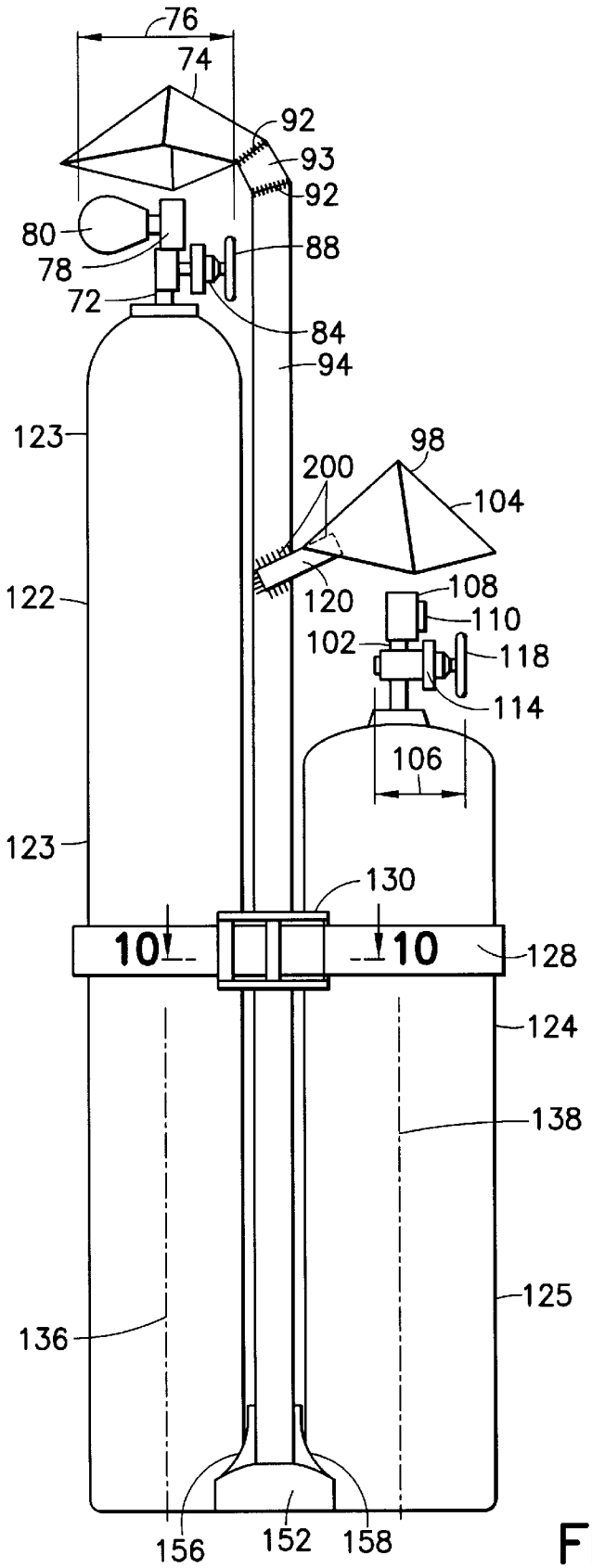
FIG. 9 is a side schematic view of a shield with fixed covers, mounted on two tanks.

Referring to FIGS. 9 and 10, fixed cover 74 of shield 70 extends over the top of control system 72 and at least as far laterally as the lateral periphery 76 of gauge 80, valve 84, regulator 78 and control handle 88 of control system 72. Cover 74, made of impact resistant material, is welded 92 or fixedly bolted to arm 93 which is welded 92 or bolted to post 94. Cover 74 prevents damage to control system 72 by impact from objects above system 72.

Preferably post 94 is made of steel square tube, arm 93 is made of steel square bar, and cover 74 is made of steel plate.

Control system 102 includes regulator 108, gauge 110, valve 114, and control handle 118. Cover 104 of shield 70 extends over the top of the regulator, gauge and valve of control system 102 and at least as far laterally as the lateral periphery 106 of control system 102 so that the valve, gauges and regulator are protected from impact from objects above the valve, gauges and regulator. Cover 104 is welded 200 to arm 120 which is welded 200 to post 94 cover 104 is angled obliquely downward from apex 98, not below the valve. Lateral access is provided to at least one of the valve, regulator and gauge. Cover 104 prevents damage to control system 102 by impact from objects above system 102.

High pressure tanks 122 and 124 are attached to post 70 by strap 128 which is tightened by ratcheting buckle 130. Preferably buckle 130 is welded to bracket 134.

Bracket 134 has two inward radius arcs 140, 142 for receiving tanks 122 and 124 respectively. Two inward radius arcs 156, 158 on bracket 152 receive tanks 122 and 124 respectively.

Tightening the belt presses tanks 122 and 124 against and into arcs 140 and 142. Tanks 122 and 124 rest in arcs 156 and 158.

The belt can be wrapped around the tanks below bracket 134 so that it presses tanks 122 and 124 into arcs 140, 142, 156, and 158.

Brackets 134 and 152 are mounted on post 94 fixedly against rotation around the post. Although welding the brackets to the post is preferred, the brackets may be bolted or otherwise affixed to the post against rotation around the post. They may be made resistant to rotation around the post by keying on the shape of the post, for example in FIG. 10. The brackets may be made of metal, steel for example, or strong plastic.

A single bracket, longer than either of brackets 134 or 152 may be used instead of two or more brackets spaced on the post so that they are spaced along the length of a tank mounted on the post.

The single bracket must be long enough to keep post 94 parallel with axis 136 of a single tank and axis 138 of a second tank when a the tank or tanks are pressed against the bracket.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

Drawing Designators (informal list)

20 cover, removable
22 control system
23 pipe
24 shell
26 shield
28 flange
30 tank
31 top end of tank 30
33 bottom end of tank 30
34 regulator
35 radius of tank
36 control handle
37 lower portion of shell 24
38 valve
39 outer diameter of tank 30
40 cylindrical body of tank 30
41 relieved slot
42 lateral periphery
43 slid up, direction arrow
44 opening at top
45 slid down, direction arrow
46 gauge
47 shield
48 inside diameter
50 outside diameter
51 tank
52 top of shell 24
53 body of tank
54 opening in bottom 56
55 control system
56 bottom of upper portion 58
57 pipe
58 upper portion of shell 24
59 valve
60 opening
61 slid down, direction arrow
62 top end of shell
63 ring
64 upper portion
65 cover
66 inside diameter of cover
67 outer diameter
68 shell
69 flange
70 shield
72 control system
74 cover, fixed
76 lateral periphery
78 regulator
80 gauge
84 valve
88 control handle
92 welded
93 arm
94 post
102 control system
104 cover, fixed
106 lateral periphery
108 regulator
110 gauge
114 valve
118 control handle
120 arm
122 tank, high pressure
123 cylindrical body
124 tank, high pressure
125 cylindrical body
128 strap
130 buckle
134 bracket
136 axis of tank
138 axis of tank
140 arc, inward radius
142 arc, inward radius
152 bracket
156 arc, inward radius
158 arc, inward radius
200 welded

What is claimed is:

1. A gas cylinder safety cover for protecting a valve, gauge and regulator mounted on the top of a gas cylinder from damage, said safety cover comprising:

a shell having a top, a lower portion of said shell, slidable along the length of the body of the gas cylinder, an upper portion of said shell having a bottom larger in diameter than said lower portion, open at the top of said shell, comprising a circumferential vertical wall extending to said lower portion, configured to extend from at least the level of the top of the valve, gauge and regulator to the bottom of the valve, gauge and regulator when the lower portion of said shell is mounted on the body of the gas cylinder, configured to laterally surround the valve, gauge and regulator as the top of said upper portion moves with said lower portion past at least one of the valve, gauge, and regulator when said lower portion is slid along the length of the body of the gas cylinder away from the valve, gauge and regulator.

2. The cover of claim 1 wherein the top of said upper portion is configured for passing below the top of the gas cylinder when said lower portion is slid along the length of the body of the gas cylinder away from the top of the cylinder.

3. A gas cylinder safety cover for protecting a valve mounted on the top of a gas cylinder from damage, said safety cover comprising:

a shell having a top, a lower portion of said shell, slidable along the length of the body of the gas cylinder, an upper portion of said shell having a bottom larger in diameter than said lower portion, open at the top of said shell, comprising a circumferential vertical wall extending to said lower portion, configured to extend from at least the level of the top of the valve to the bottom of the valve when the lower portion of said shell is mounted on the body of the gas cylinder, configured to laterally surround the valve as the top of said upper portion moves with said lower portion past the valve when said lower portion is slid along the length of the body of the gas cylinder away from the valve.

4. A gas cylinder safety cover for protecting a valve mounted on the top of a gas cylinder from damage, said safety cover comprising:

a shell having a top, an opening at the top of said shell, a lower portion of said shell, slidable along the length of the body of the gas cylinder, an upper portion of said shell, having a bottom larger in diameter than said lower portion, comprising a permanently circumferential vertical wall extending fixedly from said lower portion configured to laterally surround the valve to at least the level of the top of the valve when the lower portion of the shell is mounted on the body of the gas cylinder.

5. The cover of claim 4, wherein the bottom of said wall extends laterally adjacent to the top of said lower portion, forming an opening in said shell adjacent to said lower portion.

6. The cover of claim 5 wherein the top of said shell is movable past the top of the cylinder when said lower portion is slid along the length of the body of the cylinder.

7. The cover of claim 4 comprising:

a removable cap comprising a lip that extends below the top of said shell.

8. A gas cylinder safety shield for protecting a valve, gauge and regulator mounted on the top of a gas cylinder, said safety shield comprising:

a bar, a first bracket mounted on said bar fixed against rotation around said bar, configured for receiving a gas cylinder, means for mounting the gas cylinder on said first bracket for mounting said safely shield on the cylinder, a rigid shield mounted on said bar, configured for extending over the top of the valve, gauge and regulator at least as far laterally as a lateral periphery of the valve, gauge and regulator but not below the valve when the gas cylinder is mounted on said first bracket and to provide lateral access to at least one of the valve, gauge and regulator when the safety shield is mounted on the gas cylinder for protecting the valve, gauge and regulator from damage by a foreign object.

9. The safety shield described in claim 8, further comprising a second bracket spaced along said bar from said first bracket, mounted on said bar fixed against rotation around said bar, configured for receiving the gas cylinder for preventing rotation of the cylinder around said bar.

10. The safety shield described in claim 9 wherein said bar comprises a longitudinal key surface, and said second bracket comprises a keyway for resisting rotation of said second bracket on said bar, said keyway is configured for receiving a second gas cylinder for preventing rotation of the second cylinder around said bar.

11. The safety shield described in claim 8 wherein said bar comprises a longitudinal key surface, and said first bracket comprises a keyway for resisting rotation of said first bracket on said bar, said keyway is configured for receiving a second gas cylinder for preventing rotation of the second cylinder around said bar.

12. The safety shield described in claim 8 further comprising:

extension means for spacing said rigid shield from said bar.

13. The safety shield described in claim 8 wherein said rigid shield is angled obliquely downward from an apex on the top of said rigid shield on at least two sides of said rigid shield from a plane that is perpendicular to said bar.

14. A gas cylinder safety shield for protecting a valve mounted on the top of a gas cylinder, said safety shield comprising:

a bar, a first bracket mounted on said bar fixed against rotation around said bar, configured for receiving a gas cylinder, means for mounting the gas cylinder on said first bracket for mounting said safety shield on the cylinder, a rigid shield mounted on said bar, configured for extending over the top of the valve but not below the valve when the gas cylinder is mounted on said first bracket and to provide lateral access to the valve when the safety shield is mounted on the gas cylinder for protecting the valve against damage by a foreign object.

15. The safety shield described in claim 14, further comprising a second bracket spaced along said bar from said first bracket, mounted on said bar fixed against rotation around said bar, configured for receiving the gas cylinder for preventing rotation of the cylinder around the bar.

16. The safety shield described in claim 15 wherein said bar comprises a longitudinal key surface and at least one of said first bracket and said second bracket comprises a keyway for resisting rotation of the at least one of the brackets on said bar, said keyway is configured for receiving a second gas cylinder for preventing rotation of the second cylinder around said bar.

17. The safety shield described in claim 14 wherein said rigid shield is angled obliquely downward from an apex on the top of said rigid shield on at least two sides of said rigid shield from a plane that is perpendicular to said bar.

* * * * *